US009364079B2

(12) United States Patent
Brennan

(10) Patent No.: US 9,364,079 B2
(45) Date of Patent: Jun. 14, 2016

(54) FOLD FLAT KEYBOARD HEIGHT EXTENDER

(71) Applicant: Thaddeus Brennan, Monrovia, CA (US)

(72) Inventor: Thaddeus Brennan, Monrovia, CA (US)

( * ) Notice: Subject to any disclaimer, the term of this patent is extended or adjusted under 35 U.S.C. 154(b) by 0 days.

(21) Appl. No.: 14/834,356

(22) Filed: Aug. 24, 2015

(65) Prior Publication Data

US 2015/0359327 A1 Dec. 17, 2015

Related U.S. Application Data

(63) Continuation-in-part of application No. 13/939,057, filed on Jul. 10, 2013, now abandoned.

(51) Int. Cl.

| | |
|---|---|
| ***A47B 91/00*** | (2006.01) |
| ***A47B 21/03*** | (2006.01) |
| *A47G 23/02* | (2006.01) |
| *A45D 19/04* | (2006.01) |
| *A47J 47/16* | (2006.01) |
| *F16M 11/00* | (2006.01) |
| *H02B 1/00* | (2006.01) |
| *B65D 6/00* | (2006.01) |
| *B65D 8/14* | (2006.01) |

(52) U.S. Cl.

CPC ..... *A47B 21/0314* (2013.01); *A47B 2021/0321* (2013.01); *A47B 2021/0335* (2013.01)

(58) Field of Classification Search

CPC ..... B65D 11/1833; B65D 88/522; B65D 88/524; B65D 88/52; B65D 11/18; B65D 2519/00502; A45C 7/0036; A45C 7/0077; Y10S 248/918; Y10S 248/917; G06F 1/1607; A47B 21/0314; A47B 21/0371; A47B 2021/0321

USPC ..... 248/688, 442.2, 460, 150, 310, 346.3, 248/918, 118.1, 118.3, 158, 370, 152, 174, 248/461; 220/6, 7, 629; 312/107, 108, 258; 361/679.08, 679.11–679.16, 679.21, 361/679.26, 679.27, 679.09; 40/610

See application file for complete search history.

(56) References Cited

U.S. PATENT DOCUMENTS

| | | | | |
|---|---|---|---|---|
| 1,013,110 | A | | 1/1912 | Beers |
| 3,460,795 | A | * | 8/1969 | Dahlin ..... 248/452 |
| 3,796,342 | A | * | 3/1974 | Sanders et al. ..... 220/6 |
| 4,630,746 | A | | 12/1986 | Fortenberry |
| 4,798,304 | A | | 1/1989 | Rader |
| 5,038,953 | A | * | 8/1991 | Radar ..... 220/6 |
| 5,671,858 | A | | 9/1997 | Hsu |
| 6,010,262 | A | | 1/2000 | Linyear |
| 6,089,394 | A | * | 7/2000 | Ziglar ..... 220/6 |

(Continued)

*Primary Examiner* — Syed A Islam
*Assistant Examiner* — Taylor Morris
(74) *Attorney, Agent, or Firm* — Karish & Bjorgum, PC

(57) ABSTRACT

A folding keyboard height extender with a top plate, a bottom plate, and a right and left side hinged side arrangements. Each hinged side arrangements has an upper plate and a lower plate that are hinged to each other and between the left and right side edges of the top and bottom plates. A folding shear lock plate is hingeably attached to an underside of the top plate. In a first extended state, the right and left side hinged side arrangements form tall and straight walls, and the shear lock plate is swung down perpendicular to the top bottom plates and to the right and side hinged side arrangements. In a second lowered state, the upper and lower plates of the right and left side hinged side arrangements fold out away from the top and bottom plates lay flat against each other, and the shear lock plate is folded up and is sandwiched between the top plate and bottom plate.

12 Claims, 20 Drawing Sheets

(56) References Cited

U.S. PATENT DOCUMENTS

| | | | | |
|---|---|---|---|---|
| 6,496,360 | B1 | 12/2002 | Cordes | |
| 7,083,061 | B2 | 8/2006 | Spindel et al. | |
| 7,290,663 | B2 * | 11/2007 | Deng et al. | 206/600 |
| 7,337,914 | B2 * | 3/2008 | Spindel et al. | 220/6 |
| 7,418,907 | B2 | 9/2008 | Haimoff | |
| 7,748,667 | B1 * | 7/2010 | Bartholomew | 248/150 |
| 8,800,937 | B1 * | 8/2014 | Lee et al. | 248/65 |
| 2008/0054149 | A1 | 3/2008 | Freebairn | |
| 2008/0121188 | A1 * | 5/2008 | Axelrod et al. | 119/499 |
| 2011/0083590 | A1 | 4/2011 | Janssen | |

* cited by examiner

FOLD FLAT KEYBOARD HEIGHT EXTENDER

CROSS-REFERENCE TO RELATED APPLICATIONS

This patent application is a continuation-in-part of application Ser. No. 13/939,057, filed Jul. 10, 2013.

FIELD OF THE INVENTION

The invention relates to the field of keyboard stands and accessories therefore, and more particularly to fold flat keyboard height extended that can be mounted between a keyboard stand and a keyboard stand support to provide for height adjust of the keyboard platform between a folded flat height and an expanded different height.

BACKGROUND OF THE INVENTION

Computers have become literally pervasive in all aspects of work and many people spend their workday seated at their desks in front of a computer screen and keyboard. Studies have shown that from an ergonometric standpoint, and from a general health maintenance perspective, that it is beneficial that the height of the keyboard be perfectly adjusted to a user's needs so that excess strain on his or her body is prevented. To meet these well-known needs, numerous keyboard and mouse stands are available that mount under a desk at one end, have an extension arm extending away from the desk, and have at an opposite end with a keyboard and mouse platform(s), herein generally referred to as "keyboard platforms." Many of these prior keyboard platform designs have features to allow users to adjust the keyboard platform, such as by sliding the keyboard platform from side to side, tiling it, and/or moving it up and down.

Recent studies have shown that there are health advantages to users when they spend at least a portion of the workday standing up rather than just sitting down. Indeed, many luminaries in history preferred to use stand up or standing desks, including Benjamin Franklin, Ernest Hemingway, Leonardo da Vinci, Thomas Jefferson, and Winston Churchill. For whatever the reason, there has been a renewed interest in standup desks and desk stands. Some are touting the benefits of desks and stands that allow users to walk on treadmills. While stand up desks are gaining in popularity, most users still like the option of being able to sit at least part of the day, particularly when they start using stand up desks. To address these needs, some companies offer desks that switch between a user seated mode and a user standing mode. Unfortunately, these desks are still relatively costly and not widely available. Therefore, for users who wish to use computer keyboard at desks designed for sitting have difficult in transitioning to a standing position because the keyboard level is incapability of being changed from a first lower position, set for a seated user, to a second higher position, set for a standing user. In these common situations, the user must physically move the computer keyboard (and computer and monitor if a laptop is not being used) between two surfaces.

It would accordingly be beneficial if there were a keyboard height extended available for mounted between a keyboard stand and a keyboard stand support.

SUMMARY OF THE INVENTION

The invention is a folding keyboard height extender, comprising:

a top plate with a left side edge and a right side edge;

a bottom plate with a left side edge and a right side edge;

a right side hinged side arrangement and a left side hinged side arrangement, each right and left side hinged side arrangement comprising a upper plate and a lower plate, the upper plate having an upper edge and a lower edge, the lower plate having an upper edge and a lower edge, wherein each upper plate is hingeably attached at its upper edges to one of the left and right side edges of the top plate, wherein the lower edges of the upper plates are hingeably attached to the upper edges of the lower plates, and wherein the lower edges of each lower plates is hingeably attached to one of the left and right side edges of the bottom plate; and an inner folding wall hingeably attached to an underside of the top plate generally perpendicularly to the right side hinged side arrangement and the left side hinged side arrangement;

wherein in a first extended state, the upper plate and a lower plate of the right side hinged side arrangement and the left side hinged side arrangement extend generally end to end to form tall and straight walls, and the inner folding wall extends generally perpendicularly to the top plate and bottom plate and generally perpendicularly to the right side hinged side arrangement and a left side hinged side arrangement, wherein in a second lowered state, the upper and lower plates of the right side hinged side arrangement and the left side hinged side arrangement are laid generally flat against each other, and the inner folding wall extends generally parallel and sandwiched between the top plate and bottom plate.

In another embodiment the invention provides a folding keyboard height extender, comprising:

a top plate with and left and right side edges;

a bottom plate with a left and right side edges;

a right side hinged side arrangement and a left side hinged side arrangement, each right and left side hinged side arrangement comprising a upper plate and a lower plate, the upper plates and lower plates being hinged together and also being hinged between the left and right side edges of the top plate and the bottom plate; and an inner folding wall hingeably attached to an underside of the top plate generally perpendicularly to the right side hinged side arrangement and the left side hinged side arrangement;

wherein in a first extended state, the upper plate and a lower plate of the right side hinged side arrangement and the left side hinged side arrangement extend generally end to end to form tall and straight walls, and the inner folding wall extends generally perpendicularly to the top plate and bottom plate and generally perpendicularly to the right side hinged side arrangement and a left side hinged side arrangement, wherein in a second lowered state, the upper and lower plates of the right side hinged side arrangement and the left side hinged side arrangement are laid generally flat against each other, and the inner folding wall extends generally parallel and sandwiched between the top plate and bottom plate.

DETAILED DESCRIPTION

Figure 1:
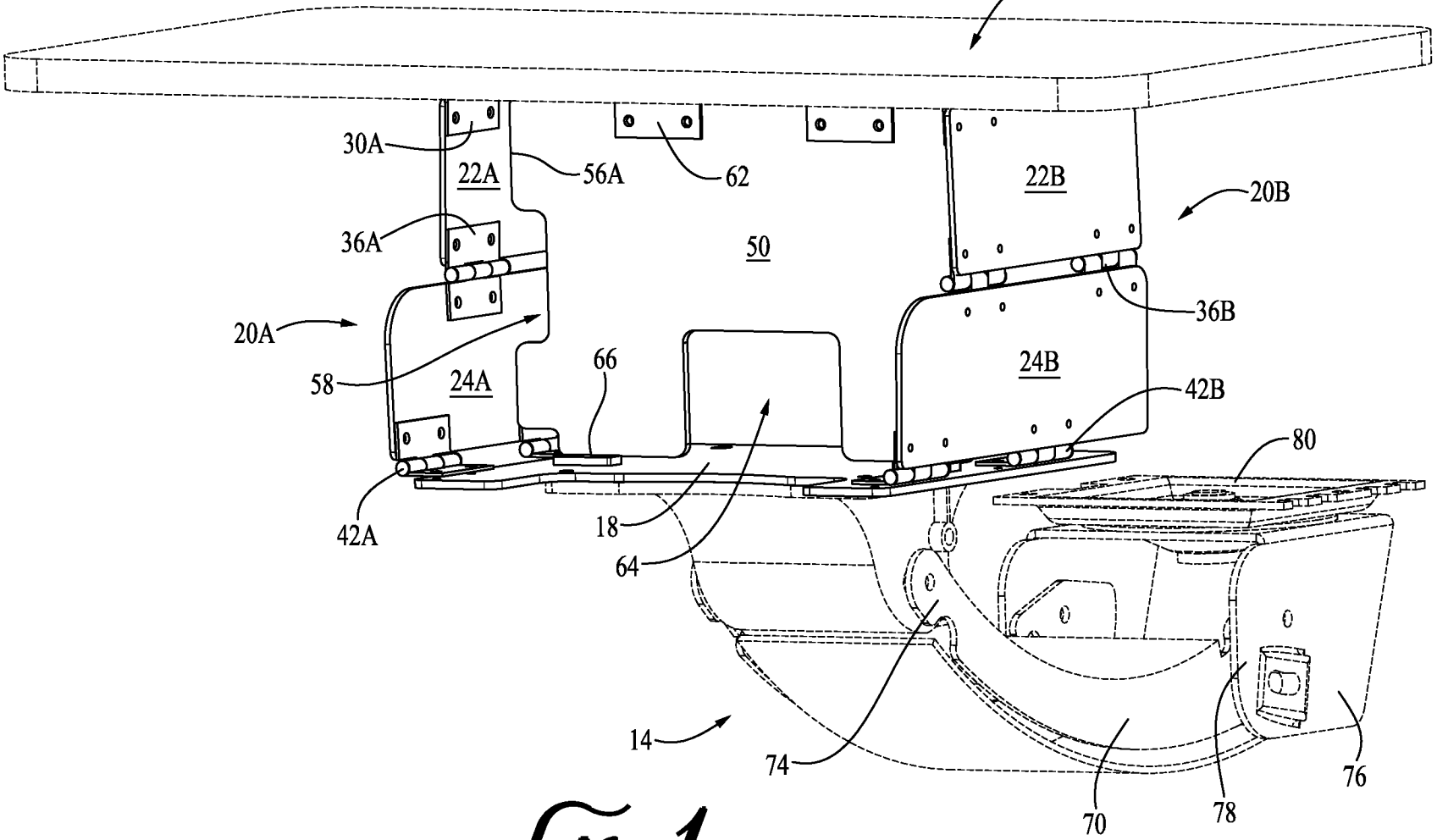
FIG. 1 is a front right isometric view of an exemplary embodiment of a folding keyboard height extender of the invention in its extended state, showing an exemplary keyboard platform and an exemplary extender arm for user thereof in phantom lines.
Figure 2:
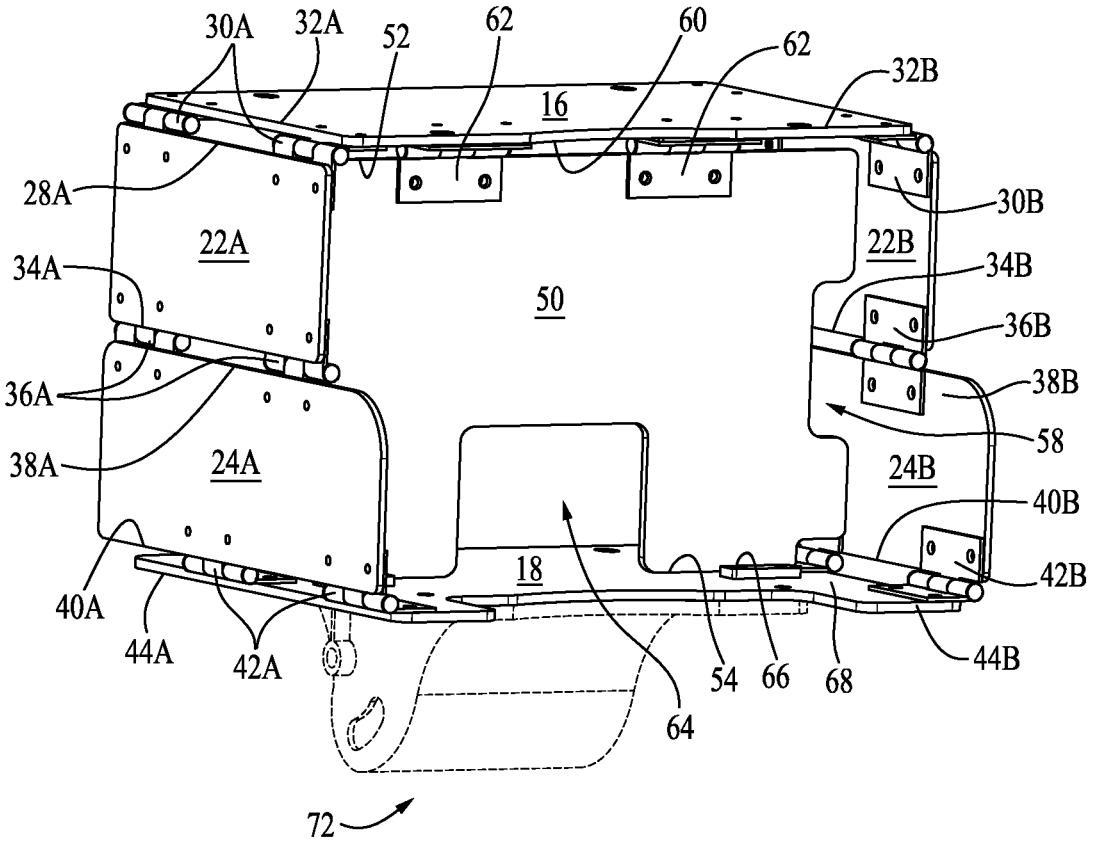
FIG. 2 is an upper front left isometric view of the folding keyboard height extended of FIG. 1, showing the extender arm in phantom lines.
Figure 3:
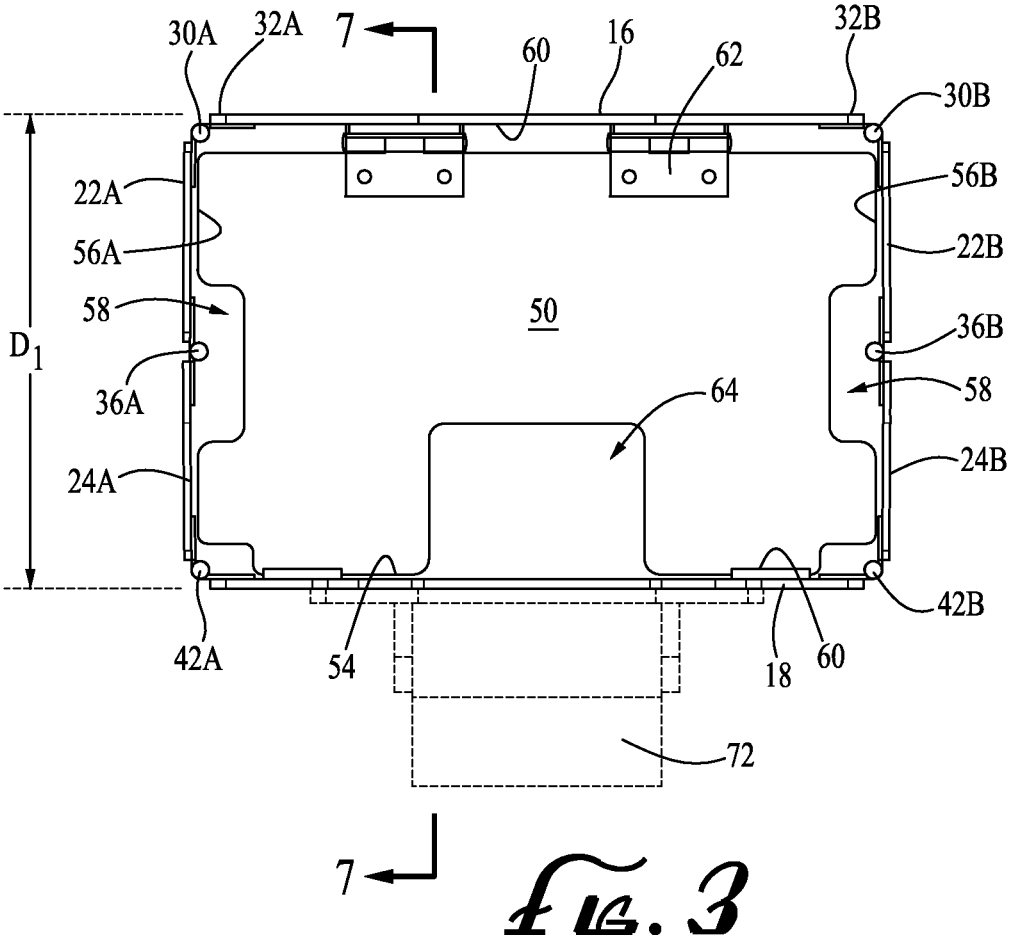
FIG. 3 is a front view of the folding keyboard height extender of FIG. 2.
Figure 4:
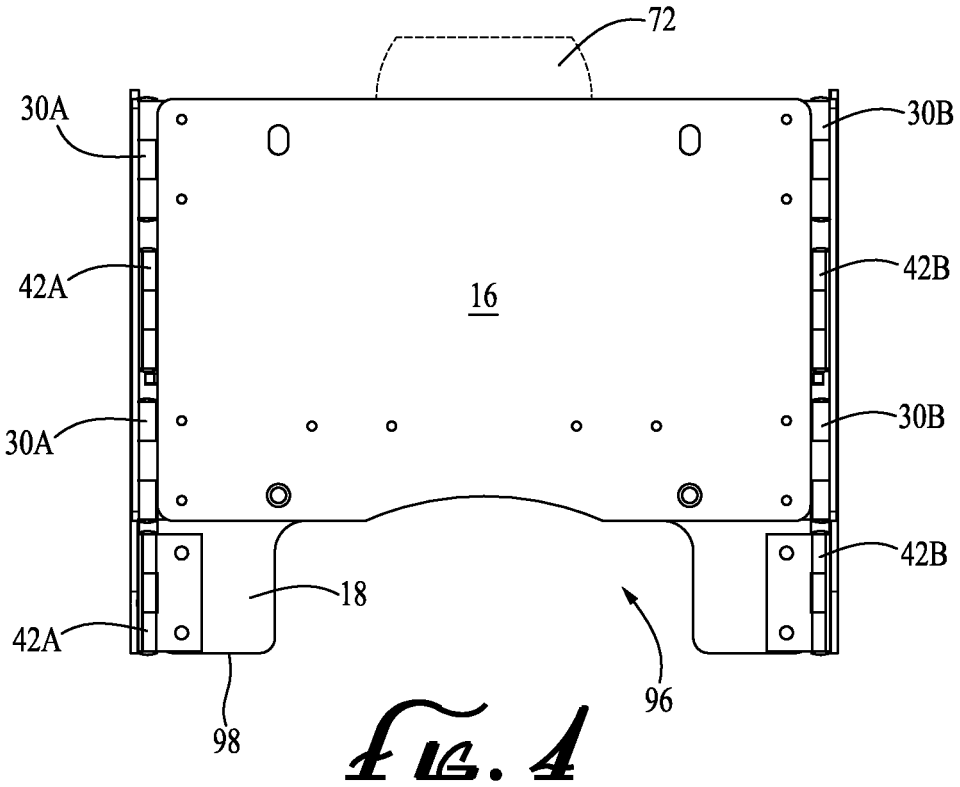
FIG. 4 is a top view of the folding keyboard height extender of FIG. 2.
Figure 5:
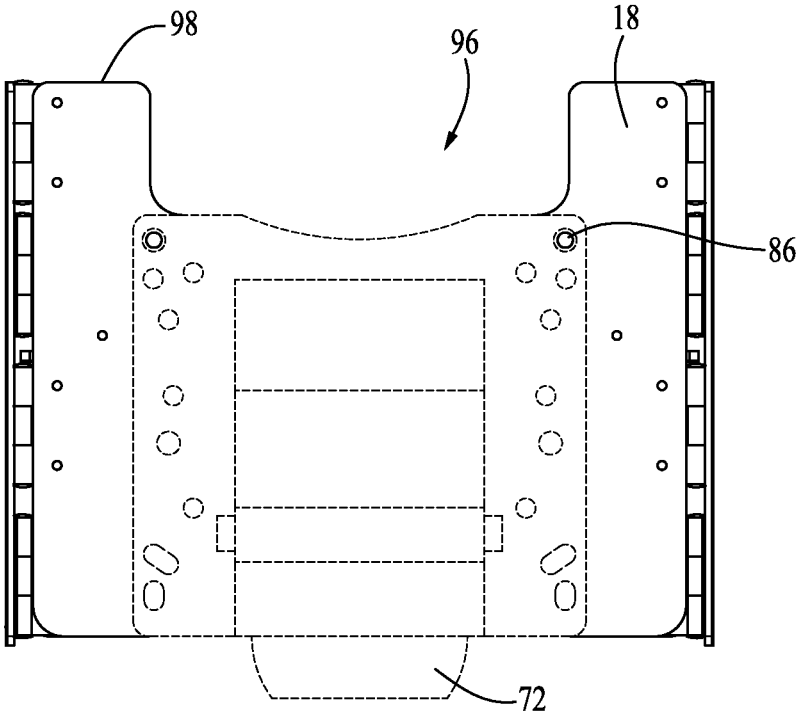
FIG. 5 is a bottom view of the folding keyboard height extender of FIG. 2.
Figure 6:
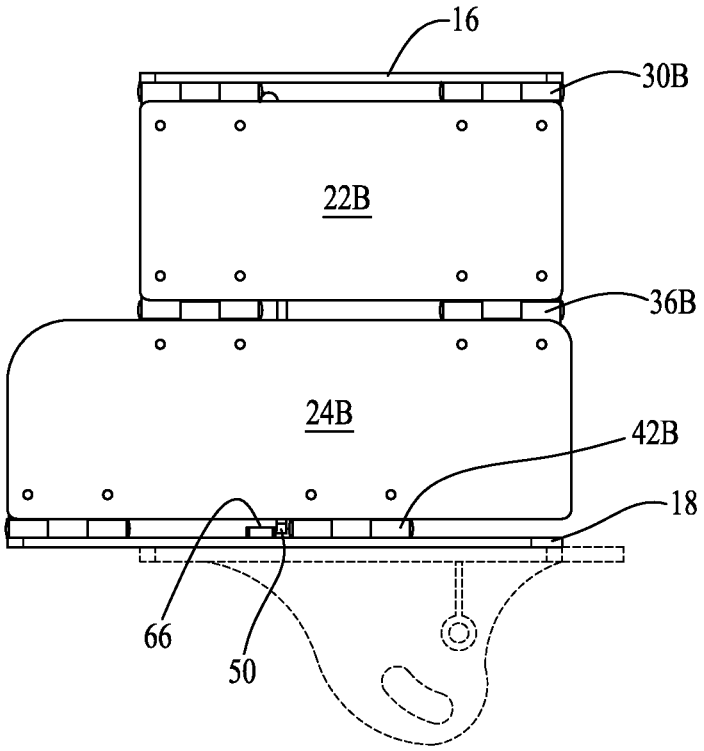
FIG. 6 is a right side view of the folding keyboard height extender of FIG. 2.
Figure 7:
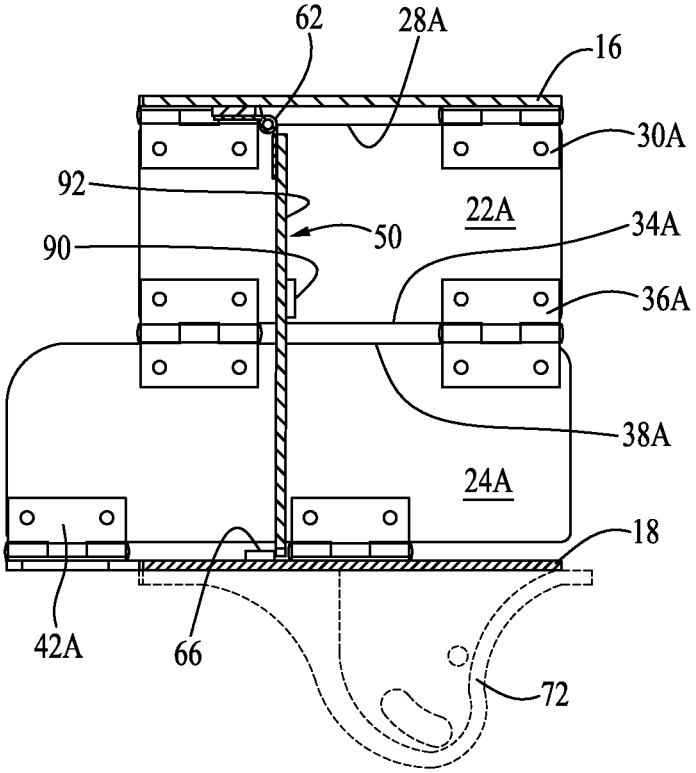
FIG. 7 is a section view through view lines 7-7 of FIG. 3 of the folding keyboard height extender.

Turning to FIGS. 1-7, there are shown various views of an exemplary folding keyboard height extender 10 of the invention in its fully raised position, wherein FIG. 1 is a front right isometric view showing the keyboard height extender 10 with a keyboard platform 12 and an exemplary extender arm device 14 for user therewith shown in phantom lines. FIG. 2 is an upper front left isometric view of the folding keyboard height extended 10 of FIG. 1, showing a keyboard bracket portion 72 of the extender arm in phantom lines but not the keyboard platform 12. FIG. 3 is a front view, FIG. 4 is a top view, FIG. 5 is a bottom view, and FIG. 6 is a right side view of the folding keyboard height extender 10 and the exemplary extender arm bracket portion 14. FIG. 7 is a section view through view lines 7-7 of FIG. 3 of the folding keyboard height extender 10 and extender arm bracket portion 14.

Figure 11:
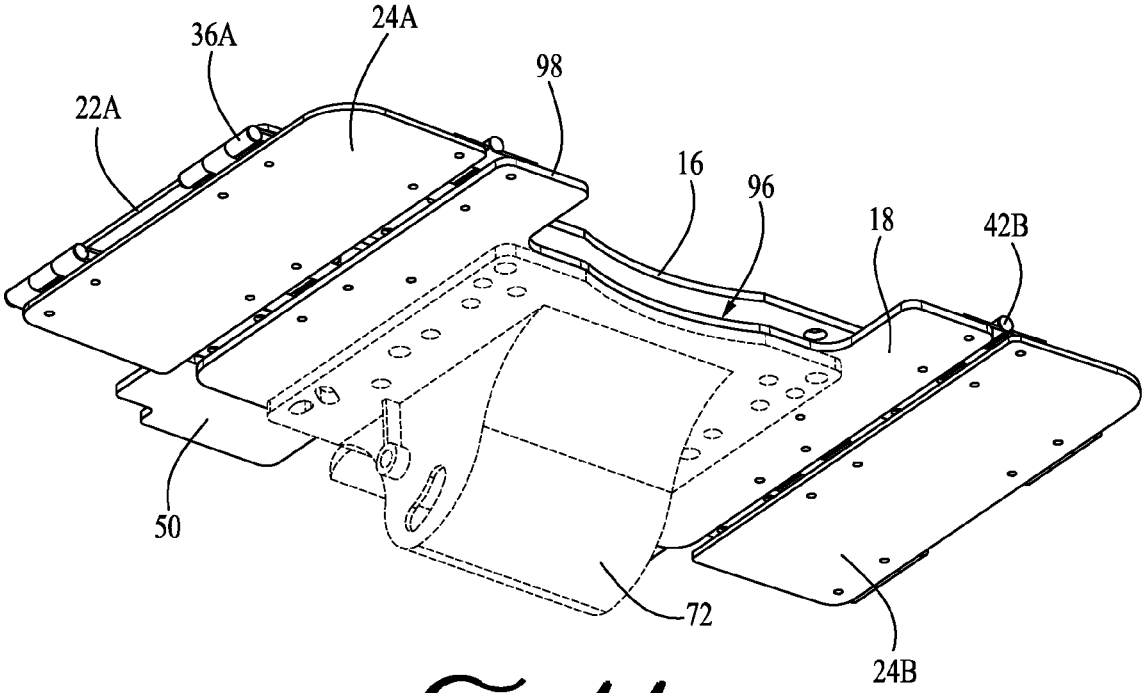
FIG. 11 is a lower front left isometric view of the folding keyboard height extender of FIG. 10, with its side walls completely folded outwardly to completely lower the top plate.
Figure 12:
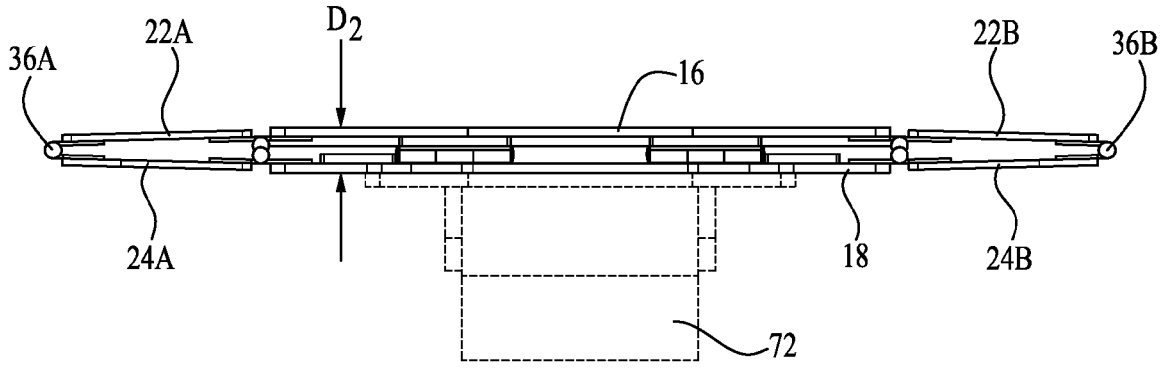
FIG. 12 is a front view of the folding keyboard height extender of FIG. 11.

The folding keyboard height extender 10 has a top plate 16, a bottom plate 18, a left side hinged side arrangement 20A, and a right side hinged side arrangement 20B. The left side hinged side arrangement 20A is made up of an upper plate 22A and a lower plate 24A. The top plate 16 and the bottom plate 18 are generally rectangular in shape. The folding keyboard height extender 10 can be made of high strength material, such as metal, plastic, composites, wood, strong glass, and the like. The upper plate 22A is hinged along a left side edge 28A via one or more hinges 30A to a left side edge 32A of the top plate 16. A lower edge 34A of the upper plate 22A is hinged with one or more hinges 36A to an upper edge 38A of the lower plate 24A. Lastly, a lower edge 40A is hinged with one or more hinges 42A to a left side edge 44A of the lower plate 18. The right side hinged side arrangement 24B is similar to that of the left side hinged arrangement 24A, and is made up of made up of an upper plate 22B and a lower plate 24B. The upper plate 16 is hinged along a side edge 28B via one or more hinges 30B to a right side edge 32B of the upper plate 16. A lower edge 34B of the upper plate 22B is hinged with one or more hinges 36B to an upper edge 38B to the lower plate 24B. Lastly, a lower edge 40B is hinged with one or more hinges 42B to a right side edge 44B of the lower plate 18. The folding keyboard height extender 10 further includes an inner folding wall 50 with an upper edge 52, a lower edge 54, and a left side edge 56A and a right side edge 56B. The left side edge 56A and a right side edge 56B can include cutouts 58 designed to clear the hinges 36A and 36B when the inner folding wall 50 is in its lowered position, as shown in FIGS. 1-3 and 7. The cutouts 58 can be generally rectangular. The inner folding wall 50 is preferably hingeably attached to an underside 60 of the upper plate 16 with at least one hinge 62. The inner folding wall 50 may additional include a lower cutout 64. The lower cutout 64 is include for user to grasp the inner folding wall 50 and also provides a space for clearance for an swing arm 70 of the extender arm device 14 in case the user wishes to swing the folding keyboard height extender 10 downwardly, where the swing arm 70 might otherwise impact on lower edge 54 of the inner folding wall 50 when the folding keyboard height extender 10 is folded flat as shown in FIGS. 11 and 12. The lower cutout 64 can be generally rectangular. The bottom plate 18 preferably also have a cutout 96 formed along a front edge 98 thereof, which cutout 96 will likewise be available to clear the swing arm 70. The cutout 96 is preferably generally rectangular in shape. When in the extended state of the folding keyboard height extender 10, the upper plates 22A&B and lower plates 24A&B of the right side hinged side arrangement 20A and the left side hinged side arrangement 20B extend generally end to end to form tall walls.

Referring to FIG. 1, the extender arm device 14 includes a swing arm 70, a keyboard bracket portion 72 pivotally attached to a distal end 74 of the swing arm 70, and a desk bracket 76 pivotally mounted to a proximal end 78 of the end of the swing arm 70. A swivel mount 80 on the desk bracket 76 permits the swing arm 70 to also be swung from side to side relative to a desk or other object the extender arm device The keyboard bracket portion 72 would normally be mounted (e.g. screwed) to the underside of the keyboard platform but for the use of the folding keyboard height extender 10 interposed therebetween.

Turning back to FIGS. 1-3 and 7, stops 66 extend upwardly from an upper surface 68 of the bottom plate 18. The stops 66 are used to prevent the inner folding wall 50 from being moved beyond the point of the stops 66, and will retain the inner folding wall 50 perpendicular relative to the top plate 16 and bottom plate 18. Thus, the inner folding wall 50 will help support the top plate 16 when the folding keyboard height extender 10 is in its extended state. The left side edge 56A and right side edge 56B of the inner folding wall 50 will preferably engage with the upper plates 22A&B and lower plates 22A&B of the left side hinged side arrangement 20A and right side hinged side arrangement 20B, respectively, and help retain the inner folding wall 50 in place, and will likewise pull up on the left side hinged side arrangement 20A and right side hinged side arrangement 20B so that their upper and lower walls remain aligned in a flat plane. In this state, the space between the top plate 16 and bottom plate 18 will be a first larger predetermined distance $D_1$, and any keyboard platform and items, such as a computer keyboard and mouse (not shown) will be raised relative to the keyboard bracket portion 72 and extender arm device 14. Again, the cutouts 58 in the inner folding wall 50 are to clear the hinges 36A and 36B during movement of the inner folding wall 50 from it extended state as shown, to its folded flat state of FIGS. 8-12. In cases where the hinges are flat with or recessed into the upper plate 22A&B and lower plate 24A&B, then the cutouts 58 are not necessary.

Figure 8:
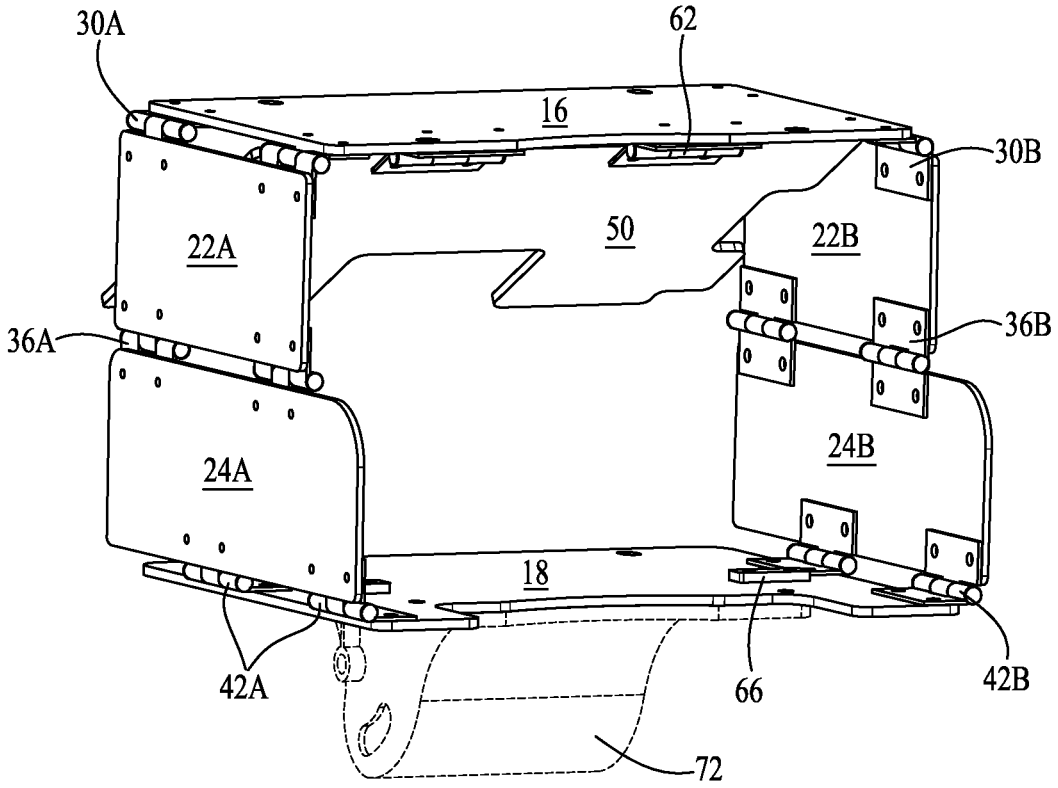
FIG. 8 is an upper front left isometric view of the folding keyboard height extender of FIG. 2, with its supporting wall partially swung upwardly.
Figure 9:
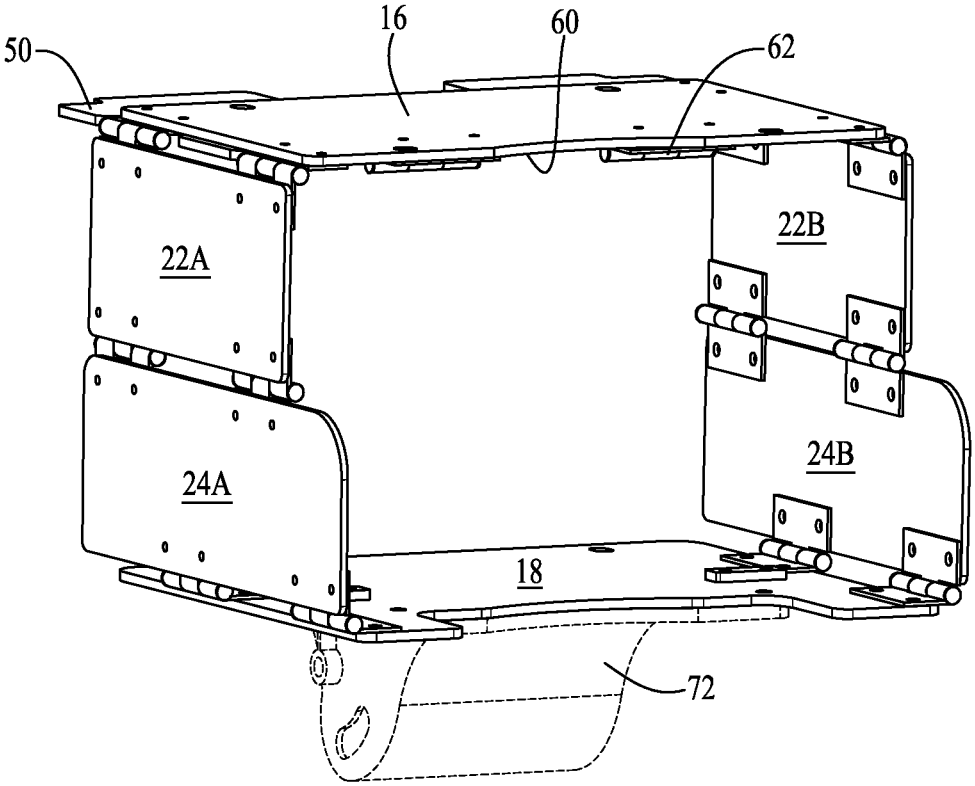
FIG. 9 is an upper front left isometric view of the folding keyboard height extender of FIG. 8, with its supporting wall completed swung upwardly.

FIG. 8 is an upper front left isometric view of the folding keyboard height extender 10 of FIG. 2, with its supporting wall 50 partially swung upwardly on its hinges 62 up towards the top plate 16, and FIG. 9 is an upper front left isometric view of the folding keyboard height extender 10 with its supporting wall 50 completed swung upwardly close to the underside 60 of the top plate 16.

Figure 10:
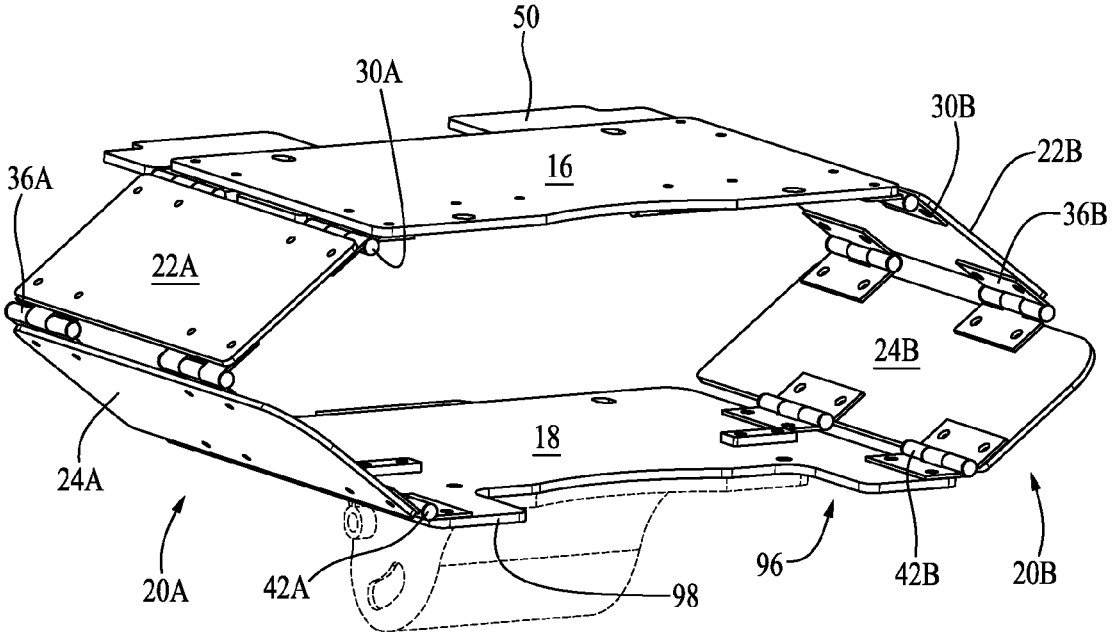
FIG. 10 is an upper front left isometric view of the folding keyboard height extender of FIG. 9, with its side walls partially folded outwardly to partially lower the top plate.

FIG. 10 is an upper front left isometric view of the folding keyboard height extender of FIG. 9, with its left side hinged side arrangement 20A and right side hinged side arrangement 20B partially folded outwardly to start to lower the top plate 16 closer to the bottom plate 18. This is accomplished with the upper plate 22A&B and lower plate 24A&B being hinged out relative to each on the hinges 30A&B, 36A&B, and 42A&B. FIG. 11 is a lower front left isometric view of the folding keyboard height extender 10, with its left side hinged side arrangement 20A and right side hinged side arrangement 20B completely folded outwardly so that the upper plate 22A&B and lower plate 24A&B, respectively are laid flat on each other to completely lower the top plate 16 onto to the bottom plate 18. FIG. 12 is a front view of the folding keyboard height extender 10 in its fold flat state. In this state, the space between the top plate 16 and bottom plate 18 will be a second smaller predetermined distance $D_2$, and any keyboard platform and items, such as a computer keyboard and mouse (not shown) will be lowered relative to the keyboard bracket portion 72 and extender arm device (not shown.)

If desired, features can be included to retain the inner folding wall 50 up against underside 60 of the top plate 16, such as one or more magnets 90 positioned on a front side 92 of the inner folding wall 50, which magnet(s) 90 will magnetically attract to the top plate 16 when it is made of steel. The position of the magnet(s) 90 can be switched to be placed on the underside 60 of the top plate 16 when the inner folding wall 50 is made of steel. In cases where the wall opposite the magnet(s) are not made or steel or other ferrous metals, a steel place can be placed opposite the magnetic. Likewise, in lieu of magnetic, detachably attachment material, such as hook and loop or hook and hook material can be used if desired. It is also possible that the hinges be formed of plastics, so that there is some friction, such that a user will need to move the plates relative to each other to change their positions. While the hinges are shown as being mounted to one side or the other of the plates, it is possible that the hinges be countersunk into the plates, or even formed together with the plates.

Figure 13:
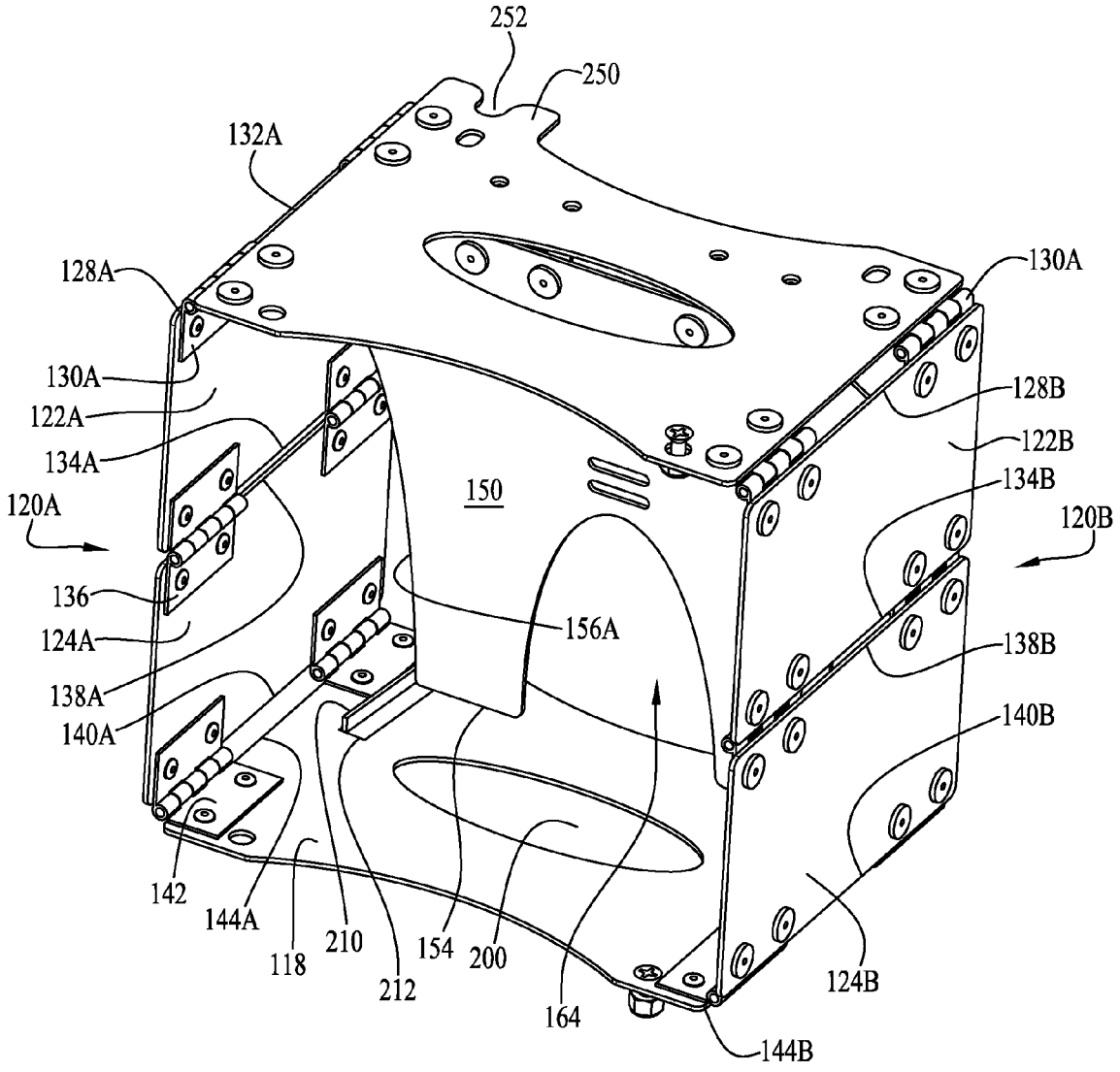
FIG. 13 is a top front right isometric view of another exemplary embodiment of a folding keyboard height extender of the invention in its extended state.
Figure 14:
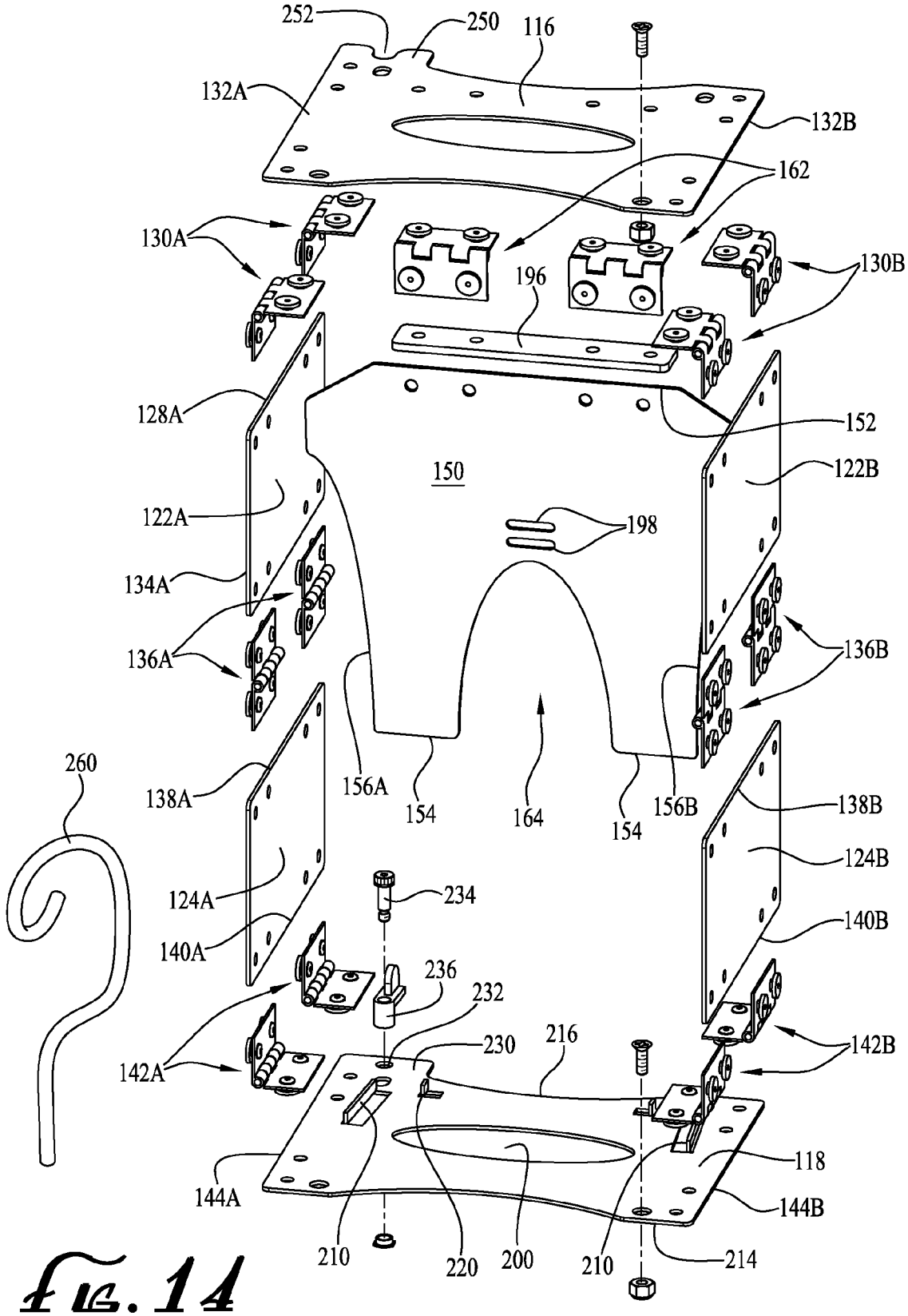
FIG. 14 is an exploded view of the parts of the embodiment of a folding keyboard height extender of FIG. 13.
Figure 15:
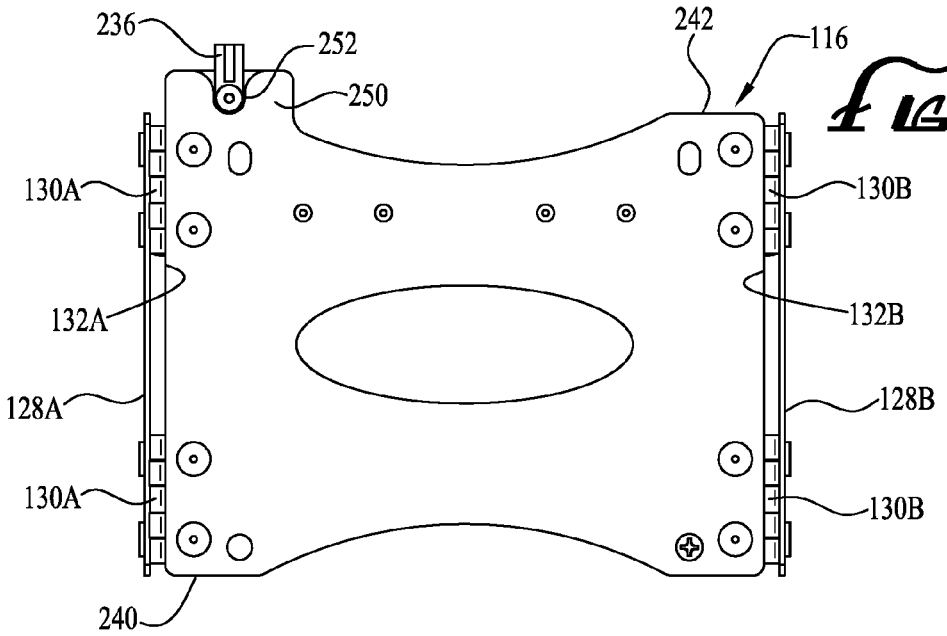
FIG. 15 top plan view of the folding keyboard height extender of FIG. 13 with its shear lock plate in its unlocked position.
Figure 16:
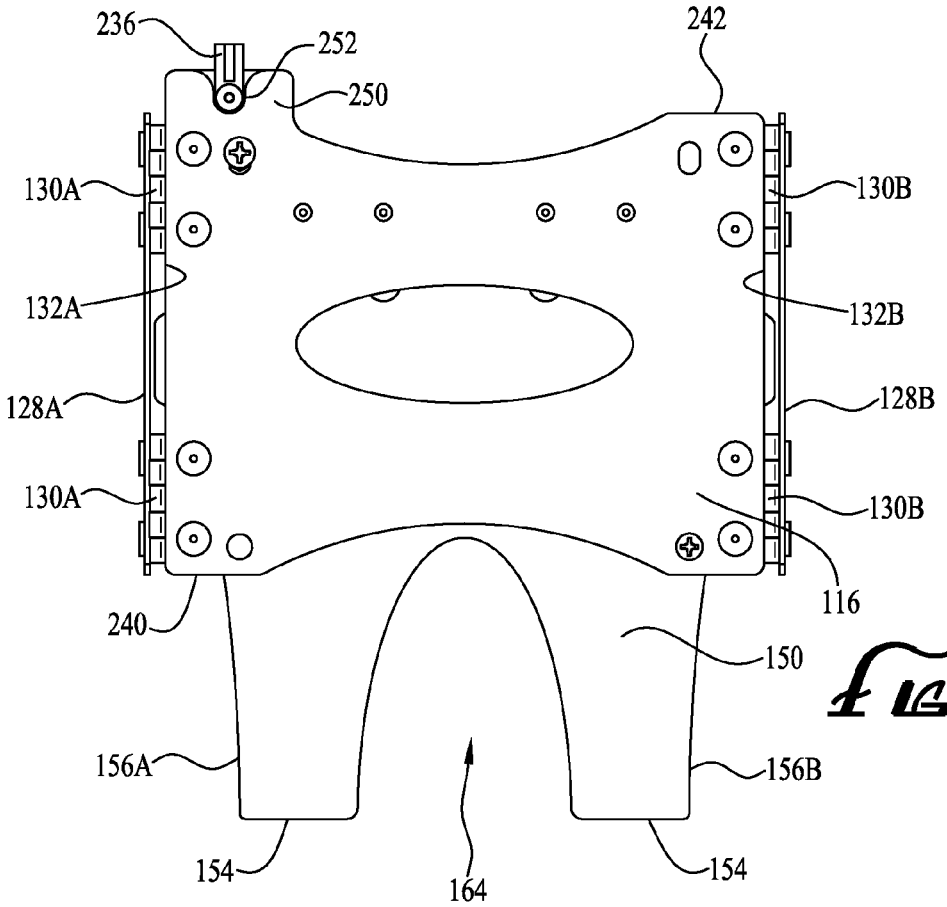
FIG. 16 top plan view of the folding keyboard height extender of FIG. 13 with its shear lock plate in its locked position.
Figure 17:
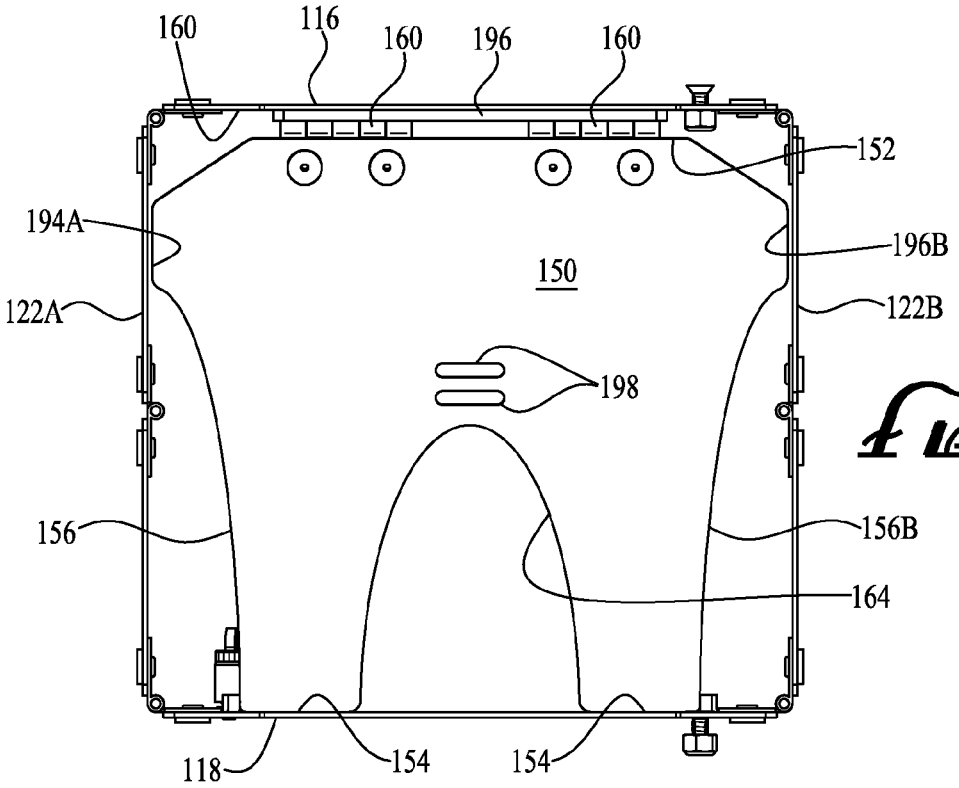
FIG. 17 is a front view of the folding keyboard height extender of FIG. 13.
Figure 18:
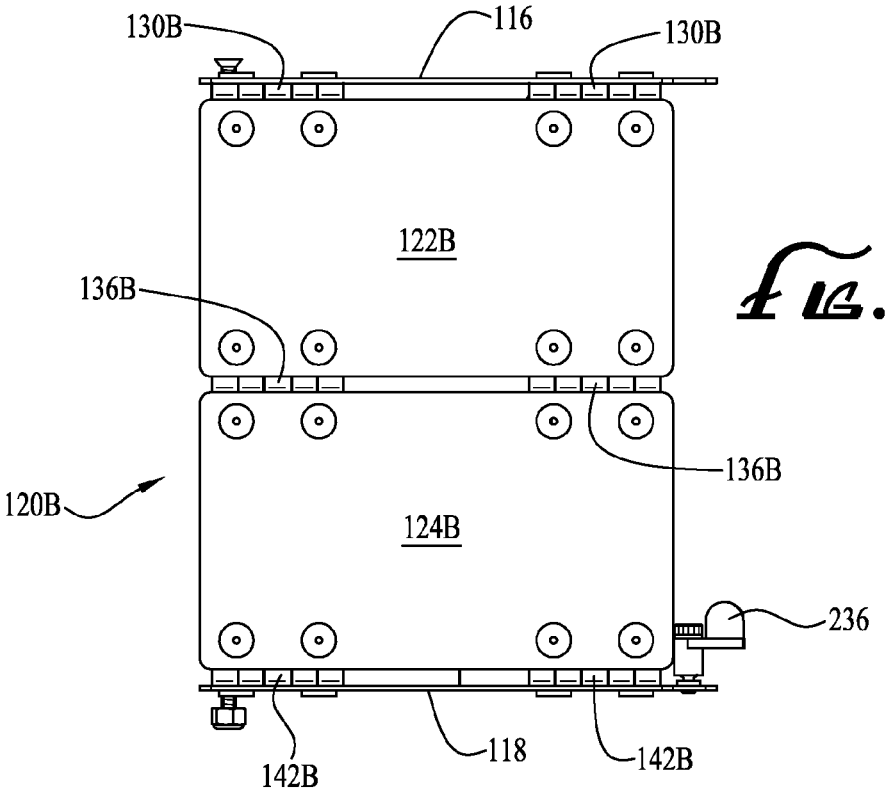
FIG. 18 is a right side view the folding keyboard height extender of FIG. 13.
Figure 19:
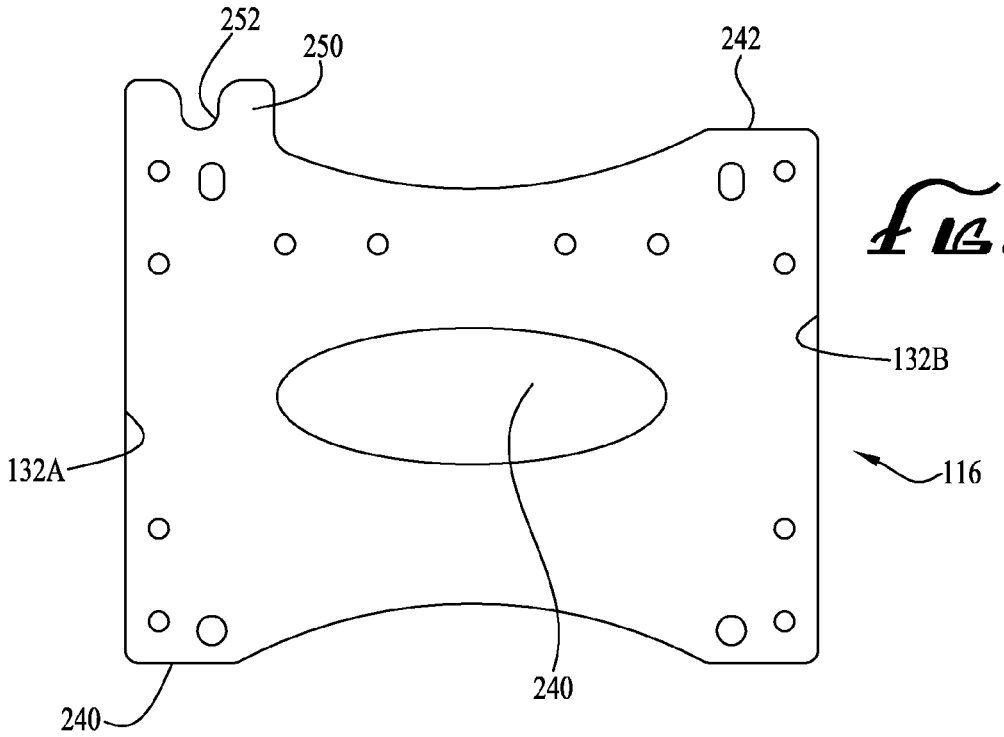
FIG. 19 is a top view of the top plate of the folding keyboard height extender of FIG. 13.
Figure 20:
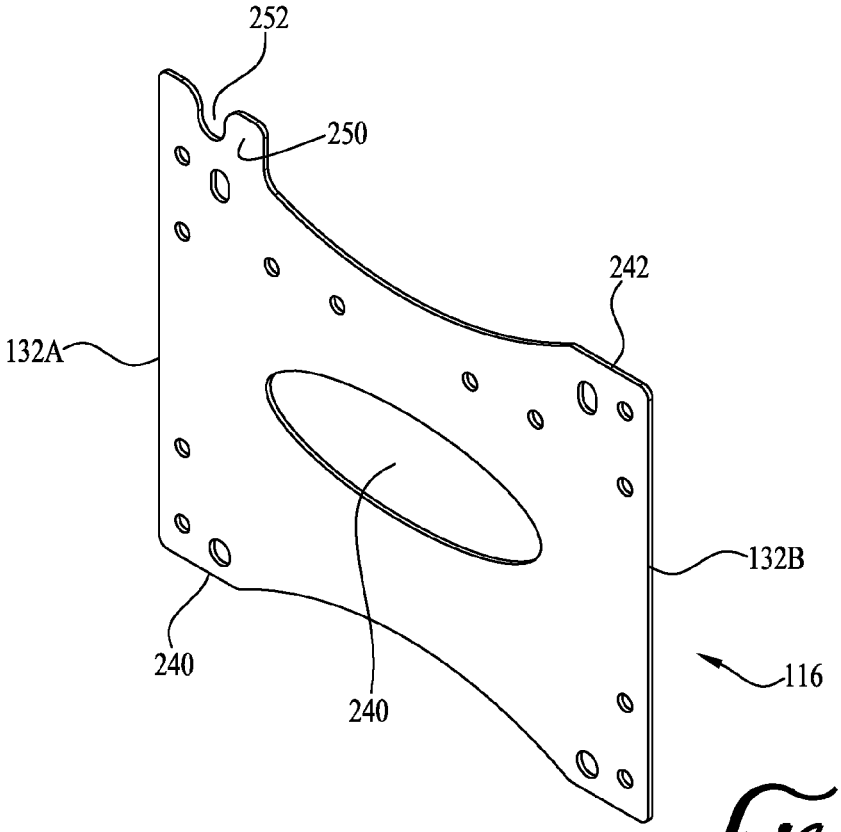
FIG. 20 is a top right isometric view of the top plate of FIG. 19.
Figure 21:
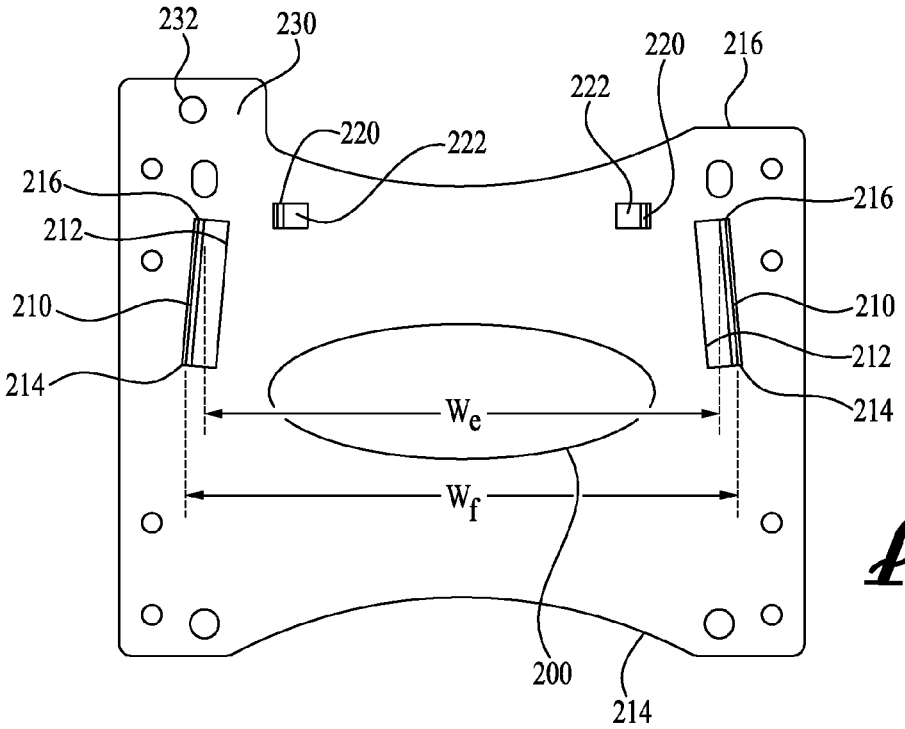
FIG. 21 is a top view of the bottom plate of the folding keyboard height extender of FIG. 13.
Figure 22:
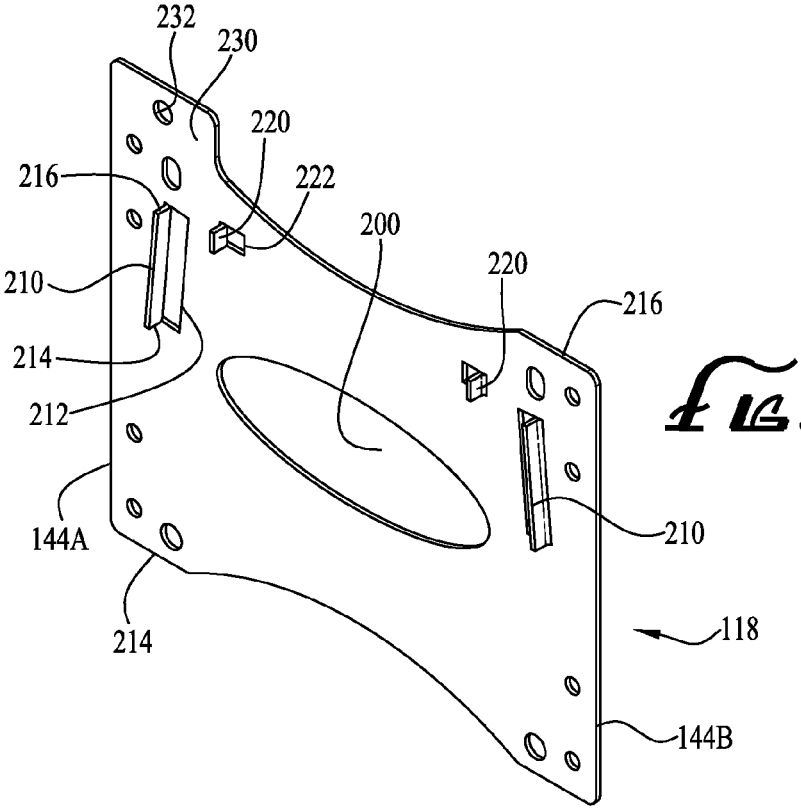
FIG. 22 is a top right isometric view of the bottom plate of FIG. 21.
Figure 23:
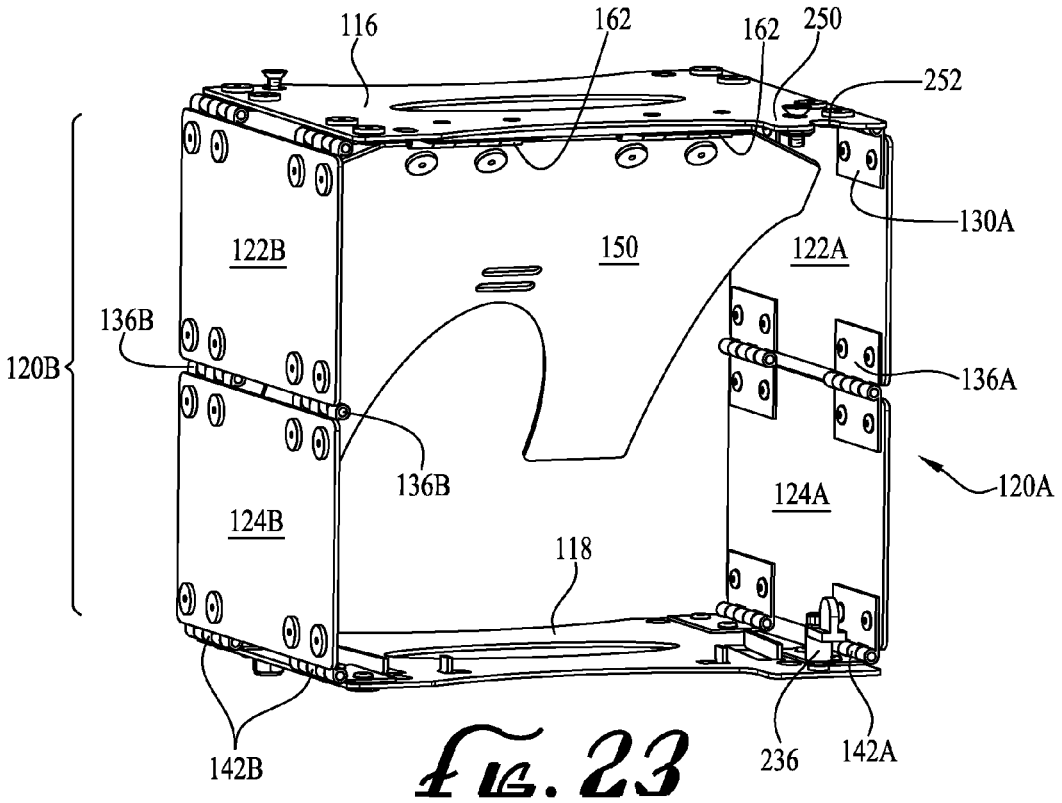
FIG. 23 is a top front left isometric view of the folding keyboard height extender of FIG. 13 but with its shear lock plate partially moved from the unlocked position to the locked position.
Figure 24:
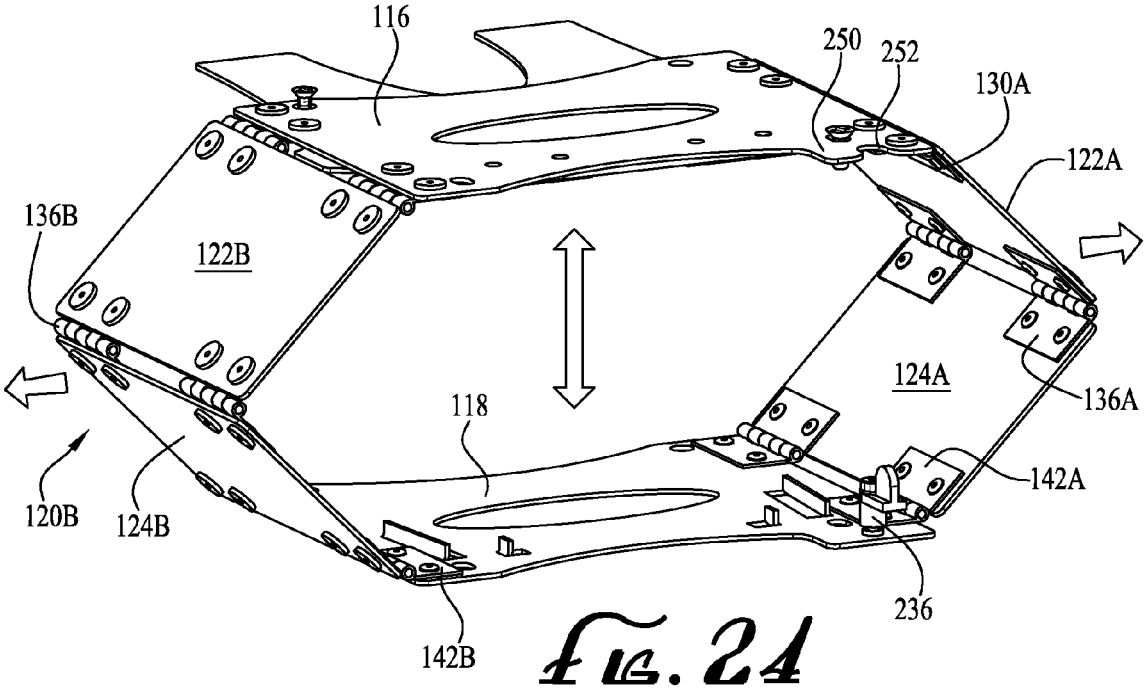
FIG. 24 is a top front left isometric view of the folding keyboard height extender of FIG. 23 but with its shear lock plate in the locked position and with the side walls partially folded out as the folding keyboard height extender is in the process of being moved to its closed position.
Figure 25:
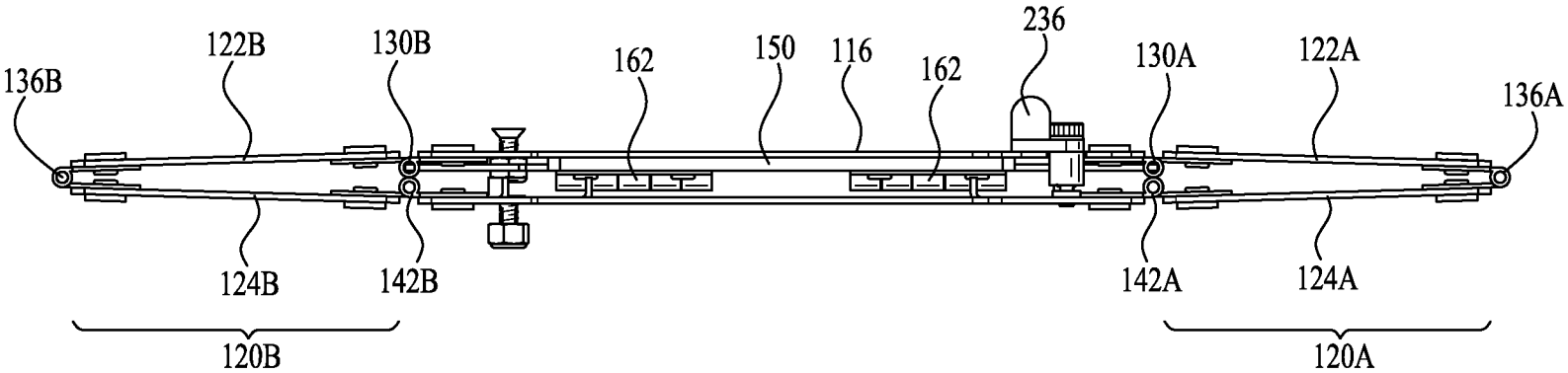
FIG. 25 is a front view showing the folding keyboard height extender of FIG. 23 completely closed.

Turning now to FIGS. 13-25, there are shown various views of another exemplary embodiment of a folding keyboard height extender 100. FIG. 13 is a top front right isometric view of the folding keyboard height extender 100 in its extended state, and FIG. 14 is an exploded view of the parts of the embodiment of a folding keyboard height extender 100 of FIG. 13. FIG. 15 top plan view of the folding keyboard height extender 100 with its shear lock plate 150 in its unlocked position and FIG. 16 top plan view of the folding keyboard height extender 100 with its shear lock plate 150 in its locked position. FIG. 17 is a front view, FIG. 18 is a right side view, and FIG. 19 is a top view of the folding keyboard height extender 100. FIG. 19 is a top view and FIG. 20 is a top right isometric view of the top plate 116 of the folding keyboard height extender 100. FIG. 21 is a top view and FIG. 22 is a top right isometric view of the bottom plate of the folding keyboard height extender 100. FIG. 23 is a top front left isometric view of the folding keyboard height extender 100 of FIG. 13 but with its shear lock plate 150 partially moved from the unlocked position to the locked position and FIG. 24 is a top front left isometric view of the folding keyboard height extender 100 of FIG. 23 but with its shear lock plate 150 in the locked position and with the side walls arrangements 120A and 120B partially folded out as the folding keyboard height extender 100 is in the process of being moved to its closed position. Lastly, FIG. 25 is a front view of the folding keyboard height extender 100 in its folded flat state.

The folding keyboard height extender 100 is formed of high strength material, such as metal, plastic, composites, wood, strong glass, and the like. The folding keyboard height extender 100 has a top plate 116, a bottom plate 118, a left side hinged side arrangement 120A, and a right side hinged side arrangement 120B. The left side hinged side arrangement 120A is made up of an upper plate 122A and a lower plate 124A. The upper plate 122A is hinged along its top edge 128A via one or more hinges 130A to a left side edge 132A of the upper plate 116. A lower edge 134A of the upper plate 122A is hinged with one or more hinges 136A to an upper edge 138A of the lower plate 124A. Lastly, a lower edge 140A is hinged with one or more hinges 142A to a left side edge 144A of the bottom plate 118. The right side hinged side arrangement 124B is similar to that of the left side hinged arrangement 24A, and is made up of made up of an upper plate 122B and a lower plate 124B. The upper plate 116 is hinged along a top edge 128B via one or more hinges 130B to a right side edge 132B of the top plate 116. A lower edge 134B of the upper plate 122B is hinged with one or more hinges 136B to an upper edge 138B to the lower plate 124B. Lastly, a lower edge 140B is hinged with one or more hinges 142B to a right side edge 144B of the lower plate 118. The folding keyboard height extender 100 further includes a shear lock plate 150 with an upper edge 152, lower edges 154, a left side edge 156A and a right side edge 156B. The left side edge 156A and a right side edge 156B are preferably directed inwardly towards each near their lower edges other so as to avoid completely impinging on the side walls arrangements 120A and 120B when they are in their extended positions. However, the shear lock plate 150 can have side abutment regions 194A and 194B near the upper edge 152 which abutment regions 194A and 194B will be ride close to or be in contact inside surfaces of the upper plates 122A and 122B when the shear lock plate 150 is in its folded down state, as shown in FIG. 17. The shear lock plate 150 can be hingeably attached to a spacer 196 which spacer 196 is in turn is attached to an underside 160 of the upper plate 116 by at least one hinge 162. The spacer 196 is useful in that it positions the shear lock plate 150 so that when it is folded up against the top plate 116 the shear lock plate 150 will lay flat. The shear lock plate 150 may additional include a lower cutout 164. The lower cutout 164 is include for user to grasp the shear lock plate 150 also provides a space for clearance for an swing arm of the extender arm device in case the user wishes to swing the folding keyboard height extender 100 downwardly, where the swing arm might otherwise impact on lower edge 154 of the shear lock plate 150 when the folding keyboard height extender 100 is folded flat. The lower cutout 164 is shown has having the general shape of parabolic segment but can have other shapes. Also shown are two slot shaped cutouts 198 which can be used to retain a pull strap 260 which pull strap 260 is useful to pull the shear lock plate 150 from its opened position shown in FIG. 17 to the closed position shown in FIG. 25. The bottom plate 118 may include a cutout 200 formed therein. Formed along the bottom plate 118 are generally vertical guide walls 210 which can be conveniently formed by making cut lines 212 in the bottom plate 18 and bending up the material to form the guide walls 210. Preferably, the guide walls 210 are angled inwardly on the bottom plate 18 from a front edge 214 to a rear edge 216, with the front edges 214 being spaced apart by a first wider distance $W_f$ compared to a narrower spacing $W_e$ at the rear edges 216. The purpose of the angled in guide walls 210 will be to cause the left side edge 156A and a right side edge 156B of the shear lock plate 150 to be tightly held in place on the bottom plate 18 when it is swung down and become immobilized when in its lowered position, and by pushing the shear lock plate 150 forward, a guarantee of snug fit is ensured. Also located on the bottom plate 18 are stops 220. The stops 220 can be formed by making cut lines 222 in the bottom plate 18 and bending up the material to thereby form the stops 220. The stops 220 are preferably located near the rear edges 216 of the guide walls 210 and will act to prevent the shear lock plate 150 from be pushed beyond the stops 220 when in its lowered position. A rearwardly extending tab 230 extends from the rear edge 216 of the bottom plate 118. It has an aperture 232 formed therein which is adapted to receive a screw 234 that rotatably retains a catch 236 to the top of the bottom plate 18. The catch 236 has a shape, such as generally L-shaped such that when it rotates on the screw, it can be selected moved into and out of contact with a catch recess 254 formed on a tab 250 on the top plate 116. The top plate 116 has a front edge 240, a rear edge 242, two side edges 132A and 132B, with the tab 250 located on the rear edge 242, the tab 250 having the catch recess 252 formed therein for receiving the catch 236 rotatably attached to the bottom plate 118. Thus, by locating the catch 236 on a tab 230 that extends from the rear edge 216 of the bottom plate 118 which catch 236 is adapted to capture on the catch recess 254 formed on the tab 250 on the top plate 116, even when the folding keyboard height extender 100 is affixed to a keyboard tray a user will still have access to move the catch 236 to be selected captured and released from the catch recess 252 of the tab 250. Various rivets or screws are used to retain the hinges to the parts of folding keyboard height extender 100.

When in the extended state of the folding keyboard height extender 100, the upper plates 122A&B and lower plates 124A&B of the right side hinged side arrangement 120A and the left side hinged side arrangement 120B extend generally end to end to form tall walls, as shown in FIGS. 13, 17, 18 and 23. However, when the shear lock plate 150 is disengaged from the guide walls 210 and swung free upwardly to make contact with an underside of the top plate 116, the upper plates 122A&B and lower plates 124A&B of the right side hinged side arrangement 120A and the left side hinged side arrangement 120B hinge outwardly from the top plate 116 and bottom plate 118. By having the upper plates 122A&B and lower plates 124A&B of the right side hinged side arrangement 120A and the left side hinged side arrangement 120B fold out away from the top plate 116 and the bottom plate 118, the top plate 116 and the bottom plate 118 can be moved closer together than they otherwise could, thereby providing a lower overall height of the folding keyboard height extender 100 when it its lowered position, as best shown in FIG. 25. Thus, with given heights of the upper plates 122A&B and lower plates 124A&B of the right side hinged side arrangement 120A and the left side hinged side arrangement 120B, a maximum differential in heights between the lowered position and raised position can be provided by this design. In the lowered position, the catch 236 will be engaged with the top plate 116 to maintain the generally flat state of the folding keyboard height extender 100. When a use wishes to thereafter raise the level of the top plate 116 of the folding keyboard height extender 100, the user will disengage the catch 236 with the top place 116 and will raise up the top plate 116, which will cause the right side hinged side arrangement 120A and the left side hinged side arrangement 120B to become plate and vertical again and will lower the shear lock plate 150 to its locked position.

The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described.

What is claimed is:

1. A folding keyboard height extender, comprising:

a top plate with a left side edge, a right side edge, a front edge, a rear edge;

a bottom plate with a left side edge, a right side edge, a front edge, a rear edge, and two spaced apart guide walls that each have a front edge and a rear edge, wherein the guide walls extend upwardly from a top surface of the bottom plate and are located inwardly from the left side edge and the right side edge and are angled inwardly towards each other from their respective front and rear edges;

a right side hinged side arrangement and a left side hinged side arrangement, each right and left side hinged side arrangement comprising a upper plate and a lower plate, the upper plate having an upper edge and a lower edge, the lower plate having an upper edge and a lower edge, wherein each upper plate is hingeably attached at its upper edges to one of the left and right side edges of the top plate, wherein the lower edges of the upper plates are hingeably attached to the upper edges of the lower plates, and wherein the lower edges of each lower plates is hingeably attached to one of the left and right side edges of the bottom plate; and a folding shear lock plate with a top edge, a bottom edge, a left side edge, and a right side edge, the shear lock plate being hingeably attached to an underside of the top plate;

wherein in a first, extended state, the upper plate and a lower plate of the right side hinged side arrangement and the left side hinged side arrangement extend generally end to end to form tall and straight walls, and the inner shear lock plate extends generally perpendicularly to the top plate and bottom plate and generally perpendicularly to the right side hinged side arrangement and a left side hinged side arrangement and wherein lower portions of the left side edge and the right side edge of the shear lock plate will impinge on inside surfaces of the two spaced apart guide walls and on a top surface of the bottom plate and thereby stabilize the first, extended state, and wherein in a second, lowered state, the upper and lower plates of the right side hinged side arrangement and the left side hinged side arrangement are folded outwardly away from the top plate and bottom plate and are laid generally flat against each other, and the inner folding wall extends generally parallel and sandwiched between the top plate and bottom plate.

2. The folding keyboard height extender of claim 1, wherein the top plate has a top tab extending from the rear edge thereof, and the bottom plate has a bottom tab extending from the rear edge thereof and has a catch rotatable connected to the bottom tab, wherein when the folding keyboard height extender is in its second, lowered state the catch rotates between a locked position where it captures the top tab and prevents the folding keyboard height extender from being moved to its first, extended position, and an unlocked position, where the catch does not contact the top tab.

3. The folding keyboard height extender of claim 1, wherein a cutout is formed along a bottom edge of the shear lock plate, and the left side edge and right side edge of the shear lock plate slant inwardly from the top edge to the bottom edge.

4. The folding keyboard height extender of claim 1, further including at least one stop extending upwardly from the top surface of the bottom plate, the stop being positioned to prevent the shear lock plate from being moved beyond the stop when the shear lock plate is in its extended state.

5. The folding keyboard height extender of claim 1, wherein hinges are provided to hingeably attach the upper and lower plates of the right side hinged side arrangement and a left side hinged side arrangement to each other and to the top plate and the bottom plate, and wherein hinges are provided to attach the shear lock plate to the top plate.

6. The folding keyboard height extender of claim 1, wherein the bottom plate is adapted to attach to an extender arm bracket for mounting.

7. The folding keyboard height extender of claim 1, wherein the top plate is adapted to attach to a keyboard platform.

8. The folding keyboard height extender of claim 1, wherein the folding shear lock plate further includes at least one pull strap aperture for pulling the folding shear lock plate out of its first, extended state.

9. A folding keyboard height extender, comprising:

a top plate with a left side edge, a right side edge, a front edge, a rear edge with a top tab extending from the rear edge thereof;

a bottom plate with a left side edge, a right side edge, a front edge, a rear edge with a bottom tab extending from the rear edge thereof, and two spaced apart guide walls that each have a front edge and a rear edge, wherein the guide walls extend upwardly from a top surface of the bottom plate and are placed inwardly from the left side edge and the right side edge and are angled inwardly towards each other from their respective front and rear edges;

a catch rotatable connected to the bottom tab;

a right side hinged side arrangement and a left side hinged side arrangement, each right and left side hinged side arrangement comprising a upper plate and a lower plate, the upper plate having an upper edge and a lower edge, the lower plate having an upper edge and a lower edge, wherein each upper plate is hingeably attached with hinges at its upper edges to one of the left and right side edges of the top plate, wherein the lower edges of the upper plates are hingeably attached to the upper edges of the lower plates with hinges, and wherein the lower edges of each lower plates is hingeably attached with hinges to one of the left and right side edges of the bottom plate; and a folding shear lock plate with a top edge, a bottom edge, a left side edge, and a right side edge, the shear lock plate being hingeably attached with hinges to an underside of the top plate;

wherein in a first, extended state, the upper plate and a lower plate of the right side hinged side arrangement and the left side hinged side arrangement extend generally end to end to form tall and straight walls, and the inner shear lock plate extends generally perpendicularly to the top plate and bottom plate and generally perpendicularly to the right side hinged side arrangement and a left side hinged side arrangement and wherein lower portions of the left side edge and the right side edge of the shear lock plate will impinge on inside surfaces of the two spaced apart guide walls and on a top surface of the bottom plate and thereby stabilize the first, extended state, and wherein in a second, lowered state, the upper and lower plates of the right side hinged side arrangement and the left side hinged side arrangement are folded outwardly away from the top plate and bottom plate and are laid generally flat against each other, and the inner folding wall extends generally parallel and sandwiched between the top plate and bottom plate, and wherein when the folding keyboard height extender is in its second, lowered state the catch rotates between a locked position where it captures the top tab and prevents the folding keyboard height extender from being moved to its first, extended position, and an unlocked position, where the catch does not contact the top tab.

10. The folding keyboard height extender of claim 9, wherein a cutout is formed along a bottom edge of the shear lock plate, and the left side edge and right side edge of the shear lock plate slant inwardly from the top edge to the bottom edge.

11. The folding keyboard height extender of claim 9, further including at least one stop extending upwardly from the top surface of the bottom plate, the stop being positioned to prevent the shear lock plate from being moved beyond the stop when the shear lock plate is in its extended state.

12. The folding keyboard height extender of claim 9, wherein the folding shear lock plate further includes at least one pull strap aperture for pulling the folding shear lock plate out of its first, extended state.

* * * * *